United States Patent [19]

Likholai et al.

[11] 4,201,420

[45] May 6, 1980

[54] METHOD OF OIL RECOVERY BY THERMAL MINING

[75] Inventors: Vasily K. Likholai; Boris A. Tjunkin, both of Komi, U.S.S.R.

[73] Assignee: Pechorsky Gosudarstvenny Naucnno-Issledovalelsley I Proerthy Institut "Pechornipineft", U.S.S.R.

[21] Appl. No.: 938,521

[22] Filed: Aug. 31, 1978

[51] Int. Cl.[2] ..... E21B 43/24; E21C 41/10

[52] U.S. Cl. ..... 299/2; 166/50; 166/303

[58] Field of Search ..... 299/2; 166/50, 303

[56] References Cited

U.S. PATENT DOCUMENTS

| | | | |
|---|---|---|---|
| 1,520,737 | 12/1924 | Wright | 166/50 X |
| 1,735,012 | 11/1929 | Rich | 299/2 |
| 1,735,481 | 11/1929 | Uren | 299/2 |
| 1,811,560 | 6/1931 | Ranney | 299/2 |
| 1,842,098 | 1/1932 | Howard | 299/2 |
| 1,935,643 | 11/1933 | Laughlin | 299/2 |
| 2,989,294 | 6/1961 | Coker | 299/2 |
| 4,067,391 | 1/1978 | Dewell | 166/50 X |
| 4,099,570 | 7/1978 | Vandergrift | 166/50 X |
| 4,099,783 | 7/1978 | Verty et al. | 299/2 |
| 4,101,172 | 7/1978 | Rabbitts | 299/2 |

*Primary Examiner*—Ernest R. Purser

*Attorney, Agent, or Firm*—Steinberg and Blake

[57] ABSTRACT

A method of oil recovery by thermal mining from oil deposit sections into which the mine field is divided, according to which a plurality of underground workings are provided ensuring a successive recovery of oil from the mine field sections. The plurality of underground workings include intake and development wells. Thereupon, an overall mine ventilation system is set up ensuring the ventilation of the workings. Prior to the supply of heating medium to the development wells, the flow of heating medium is throttled. Then, the throttled heating medium flow is force-fed via pipes into the development wells for heating the oil bed to the temperature at which oil assumes the required fluidity in the oil bed. A fluid medium is then force-fed to the intake wells to force oil from the oil bed into the development wells and pump it up to the surface.

7 Claims, 4 Drawing Figures

METHOD OF OIL RECOVERY BY THERMAL MINING

The present invention relates to the sphere of developing oil deposits and, more particularly, it relates to a method of oil recovery by thermal mining.

This invention can be used most advantageously for developing deposits of high-viscosity oil, which cannot be efficiently developed by conventional surface recovery methods.

The present invention can also be utilized for developing deposits of bitumen.

There are known in the art methods of thermal mining of oil which, under conditions of natural occurrence, cannot be extracted from the oil bed in an economically effective amount without reducing its viscosity.

The reduction of viscosity in said prior art methods is attained by increasing the temperature of the oil bed by way of forcing a heating medium into the latter through holes drilled from mine workings located above the bed or from workings located directly in the oil bed, while oil is driven out of the oil bed with the aid of repressuring.

For example, there is known in the art a method of oil recovery by thermal mining wherein a heating medium is fed through holes drilled from a development underground working in the oil bed, said heating medium being supplied to cased holes via pipes provided with a packer near the face while oil is extracted through perforated openings in the casing column near the mouth of the same holes (cf., U.S.S.R. Inventor's Certificate No. 199,058). However, the heating medium fed into a bed with high-viscosity oil, according to the latter method, cannot penetrate the bed pores and drive oil therefrom inasmuch as the heating of the bed upon contact with the casing string improves the filtration characteristics of the bed, which makes for the inrush of coolant behind the casing string to the well mouth.

In so doing, the heating medium which performs no useful work of driving oil out of the oil bed leaves the well mouth via perforated openings provided in the casing string. This results in a high consumption of coolant and low efficiency of oil recovery.

In addition, when recovering oil from a fissured oil bed, the heating medium being pumped in spreads via fissures beyond the limits of the section being developed or penetrates the development underground working, which also results in an increased consumption of heating medium while the atmosphere of the underground working gets heated to a temperature exceeding that permitted by sanitary regulations.

For normalization of temperature conditions in underground workings, special measures are required aimed at contitioning the mine atmosphere, which call for considerable expenditure.

There is further known a prior art method (cf., U.S. Pat. No. 1,634,235) wherein mine shafts and a system of underground workings are set up above or below the oil bed, after which a dense network of straight holes are drilled into the oil bed through a streak from said underground workings arranged in parallel with the oil bed plane but separated from the oil bed with a fluid-impermeable streak. The holes are equipped in the streak with nipples connected to the oil collection line laid out in the underground working. Oil from the oil bed is drained to the holes and then into the collection line via which it is conveyed to the mine shaft and pumped up to the surface.

With a view to intensifying the oil recovery, the pressure in the oil bed is increased by air or water drive or, in the case of high-viscosity oils, heat treatment is applied by way of heating the oil bed with steam.

The steam is supplied via steam line laid out in the underground workings and provided with branch pipes sunk in the holes. The steam fed to a hole heats the walls of the latter and returns to the collecting line together with stratal fluids that are pumped up to the surface. In addition, this method provides for the delivery of steam to pipes whose ends are stopped with lids to form heaters. In so doing, the steam does not mix with stratal fluids but only releases its heat through the pipes to the hole walls to reduce the oil viscosity in the oil bed near the holes. Said method further provides for the delivery of steam from the steam line in the underground working to the hole via pipe bent at the hole face and returning said steam to the steam line whence the steam is directed to the subsequent hole, and so on.

A serious disadvantage of said prior art method resides in that a great number of holes drilled vertically from underground workings into the oil bed through an impermeable streak and provided with heating pipes, apart from heating up the oil bed, heat up the streak which serves as the roof or foot for the underground workings. In so doing, part of the heat is spent on heating the streak, thereby reducing the efficiency of the thermal drive process. In addition, the atmosphere of the underground workings is heated by the streak, causing an increase in the costs of ventilating and normalization of the temperature conditions in the underground workings. A further disadvantage of said method, resulting from heating the oil bed by means of plugged and bent pipes, consists in that the heating of the bed only takes place due to thermal conductivity thereof and, therefore, the rate of heating is low. For fully heating the bed, a dense network of holes is required, further increasing their costs.

There is also known a method for recovery of high-viscosity oil by thermal mining (cf., U.S.S.R. Inventor's Certificate No. 446,631), according to which a plurality of underground workings are provided above the oil bed. Then, intake wells are driven from said underground workings for supplying the heating medium into the bed. After that, incline and footway are provided to the bottom portion of the oil bed, where a development underground working (gallery) is set up. From said development gallery, horizontal and inclined holes are drilled for the recovery of oil. The heating medium is force-fed to the intake wells for distribution over the oil bed and for driving oil to the development wells towards the development gallery, whereupon oil is delivered from the development gallery via network of underground workings to the surface.

An inherent disadvantage of said latter method resides in the need for driving a dense network of underground workings above the oil bed that are required for drilling from them a great number of intake wells and for the supply of coolant for a fuller heating of the bed. While passing through above-bed rock, vertical and steep dipping intake wells heat up the latter and the atmosphere of underground workings driven in said rock, which results in the loss of heat delivered to the oil bed.

The latter prior art method further suffers from the need for ventilating the underground workings from which the intake wells are drilled and coolant is supplied to the latter, as well as the development gallery which serves for collecting oil recovered from the development wells. In so doing, a profuse heat release into the atmosphere of said underground workings, due to the fact that the heated walls of the workings are washed with the ventilation jet and the heating medium penetrates said walls through cracks and further into the development wells, calls for the need of normalization of temperature conditions in underground workings by taking special measures aimed at conditioning the mine atmosphere. In particular, the improvement of temperature conditions in the underground workings by way of increasing the amount of air supplied to the mine for heat absorption results in considerable expenditures for providing and maintaining the ventilation system or, with the existing ventilation system, in a reduction of the oil output of the mine.

The large number of intake wells required according to the latter method for fuller heating of the oil beds results in considerable hole drilling and maintenance costs, as well as adds to the difficulties involved in their control and adjustment.

The penetration of heating medium into the development wells calls for the shutdown of the latter, which results in the formation of sand plugs and frequent shutdowns of the wells for repair purposes.

It is an object of the present invention to eliminate the major drawbacks of the afore-listed prior art methods.

It is the primary object of the invention to increase the oil recovering capacity of mines while reducing to the minimum the construction and operation costs.

Also an important object of the present invention is to reduce the heat consumption per ton of recovered oil.

Still another important object of the invention is to normalize the temperature conditions in underground workings and to improve sanitary conditions of labor in mines at minimum ventilation costs.

In the accomplishment of said and other objects of the present invention, in a method of oil recovery by thermal mining from oil deposit sections into which the mine field is divided, wherein a plurality of underground workings are provided ensuring a successive recovery of oil from the mine field sections and including intake and development wells, and an overall mine ventilation system is set up ensuring the ventilation of said underground workings, whereupon a heating medium is force-fed via pipes into the development wells for heating the oil bed to a temperature at which oil assumes the required fluidity in the oil bed, after which a fluid medium is forcefed to the intake wells to drive the oil from the oil bed into the development wells and pump it out up to the surface, in which method, according to the present invention, the coolant flow is throttled prior to the supply of coolant into the development wells.

The method of the present invention provides for an automatic control over the supply of heating medium to development wells and extraction of oil from the same wells, while obviating the need for repairing the wells because of difficulties caused by the plugging of the wells with sand deposits and other mechanical particles, whereby the underground workings of the oil bed being heated can be separated from the overall mine ventilation system.

It is expedient that, prior to the supply of the throttled flow of heating medium to the development wells, the underground workings of the oil bed section being heated should be separated from the overall mine ventilation system.

This helps preclude the cooling of the oil bed sections being heated by a ventilating jet intended for the oil bed underground workings and, thereby, increase the efficinecy of heating the oil bed sections with heating medium.

In addition, this results in a reduced heating medium consumption for the recovery of oil, helps normalize the temperature conditions in the mine ventilation workings and makes for a considerable increase in the recovery of oil without additional ventilation costs.

It is desirable that the supply of heating medium and separation of the oil bed underground workings from the overall mine ventilation system should be carried out successively in the oil field sections, starting from the mine field boundaries towards the central portion thereof.

This helps, while heating the oil bed, preclude the cooling of said oil bed because of the ventilation of the main preparatory underground workings of the mine throughout their length and increase the efficiency of heating the entire oil bed with heating medium, as well as provides for a reduced consumption of heating medium for heating the entire oil bed when recovering oil therefrom.

In addition, this makes for normalizing temperature conditions in the main preparatory underground workings of the mine and for reducing the overall mine ventilation costs, as well as the costs of driving underground workings for the purpose.

It is further desirable that the flow of coolant to the development wells should be delivered via pipes thermoisolated at the wellhead and run down to the face of said wells. This helps increase the area of contact of the heating medium flow moving in the development well with the oil bed throughout the length of the well and to prevent the heating of the pulp in that zone.

This further provides for the entrainment by the heating medium of sand from the development well and helps preclude the formation of sand plugs throughout the entire length of the well.

It is expedient, in the case of recovering oil from a well cemented oil bed stable to heating, that the flow of heating medium should be delivered into uncaused development wells, and in the case of poorly cemented oil bed the wells may be equipped with filters of known construction.

This helps ensure a direct contact of heating medium with the oil bed in the development well and the fullest possible utilization of the entire uncased surface of the development well for filtering oil, as well as reduce the cost of outfitting development wells.

It is also desirable, in case the temperature of heating medium returning from the development wells to the underground working of the oil bed section being heated is higher than the oil bed temperature in the adjacent section where no coolant has yet been supplied to the development wells, that the same heating medium should be re-cycled to the development wells of the adjacent section in accordance with the flow sequence of developing the mine field sections.

This helps most fully utilize the heating medium and effect the pre-heating of the oil bed sections, as well as provides for a reduced heat consumption for the recovery of oil.

The present invention will be better understood upon considering the following detailed description thereof to be taken in conjunction with the accompanying drawings in which.

Figure 1:
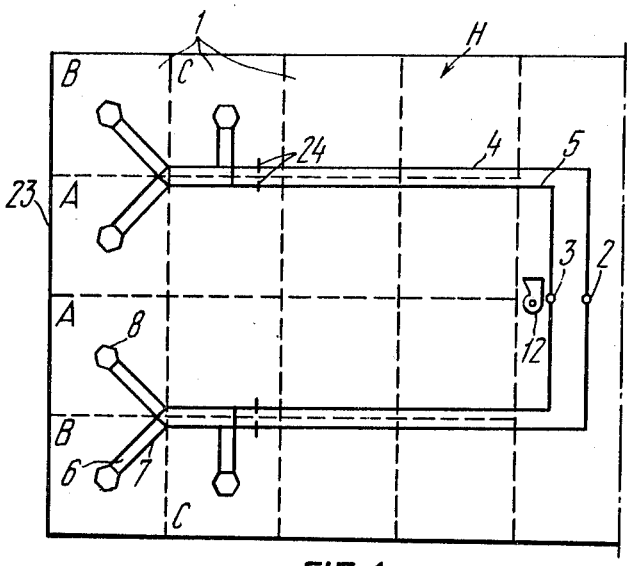
FIG. 1 shows an oil deposit mine field divided into sections having underground workings.
Figure 2:
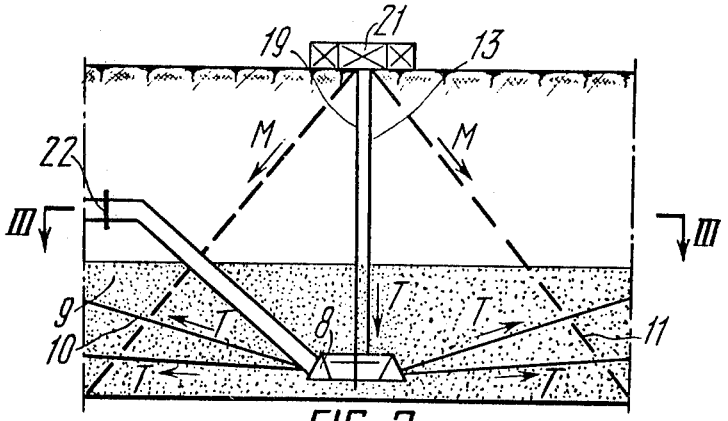
FIG. 2 is a sectional elevation of an oil bed section with underground workings and wells.

Referring now to FIG. 1 of the drawings, a mine field H of an oil deposit is divided into sections 1 arranged in succession, for example, A, B and C. The sections may have different area and configuration such as square, rectangular, hexahedral. A network of underground workings is set up including a mine shaft 2 and a ventilation shaft 3 for opening up the mine field H, main preparatory workings (haulage workings 4 and ventilation workings 5) for preparing the sections 1 for development, an incline 6, a footway 7 and a development gallery 8 for opening up the section 1 of an oil bed 9 (FIG. 2). All of the underground workings are done in a conventional manner by drifting and timbering. The development gallery 8 is driven in the oil bed 9, preferably, at the foot thereof, with a view to the maximum utilization of gravitational forces for fuller oil extraction. Drilled from the development gallery 8 are flat-slope and horizontal development wells 10 serving for the delivery of heating medium to the oil bed and for extracting oil from the latter. The direction of the heating medium movement is shown in the drawing with arrow T.

The development wells 10 are located lengthwise uniformly over the volume of the oil bed 9 in a single row or more in a vertical plane, depending on the depth of the oil bed. In the rows, the development wells 10 are arranged radially or in parallel, depending on the configuration of the development gallery 8.

The delivery of heating coolant T to the bed 9 via system of horizontal and flat-slope wells 10 arranged in the oil bed throughout their length ensures a uniform heating of the bed as a result of a large area of the heating coolant contact with the producing bed through the well walls and natural bed disturbance zones (fissures, caverns, etc.) crossed by the horizontal wells to a greater extent than by the vertical ones, which, in turn, ensures a high injectivity of heating coolant in the wells and, consequently, reduced amount of drilling to be done.

The horizontal and flat-slope position of the development wells 10 provides for a higher surface area over which oil is drained from the bed and makes for a free flow of stratal fluids (oil, stratal water) into the development gallery 8 under the effect of forces of gravity, precluding the formation of rock plugs in the wells, and, thereby, increasing the service life of the wells without restorative repairs.

The use of the same wells for delivering the heating medium to the oil bed and for extracting oil therefrom reduces the cost of drilling wells and driving underground workings required when employing other methods of oil recovery by thermal mining.

Intake wells 11 are drilled from the surface or from above-bed underground workings for driving oil by the fluid medium from the oil bed after heating the latter. Steam, hot or cold water with the addition of surface-active agents can be used as the fluid medium. The direction of the fluid medium movement is shown in the drawing with arrow M.

For performing work in the underground workings an overall mine ventilation system is set up, including continuously acting main fans 12 (FIG. 1) installed on the surface near the mouth of the ventilation shaft 3 and designed to suck the air from the mine and provide a general depression in the mine, as a result of which atmospheric air is supplied into the mine shaft 2 and washes over all of the underground workings in the mine.

For supplying the heating medium to the oil bed, a well 13 (FIG. 4) is drilled from the surface into the development gallery 8 and cased off with a casing string. A manifold 14 is provided in the development gallery 8 and connected with the heat source through the well 13. The manifold 14 is essentially a pipeline laid throughout the entire length of the development gallery 8 and having branch pipes 15 running to each one of the development wells 10. The branch pipes 15 are connected to pipes 16 which are thermoisolated at the wellhead and run down into each one of the development wells 10 down to the face thereof. Mounted in the pipes 16 near the mouths of the development wells 10 are throttling means 17 designed to regulate the delivery of heating medium T to the development wells 10. The throttling means 17 may consist of union pipes having orifices of varying diameters. The union pipe orifice should be capable of admitting the required amount of heating medium into the well 10. By no means does the design of the throttling means 17 restrict the scope of the invention, for said means can be of any conventional design suitable for the purpose. The provision of the throttling means 17 near the mouth of the well 10 ensures a ready access to said means for assembly, adjustment and repair purposes, yet the throttling means may be mounted at any point of the pipe 16.

For pumping up to the surface the oil accummulated in the development gallery 8 in the form of pulp 18 consisting of oil, stratal water, heating medium and sand, a hole 19 is drilled from the surface directly into the development gallery 8. Via said hole 19, a pump 20 is sunk down into the gallery 8. The pump is serviced from the surface, this improving the safety of operation by obviating the need for placing explosion hazardous equipment and service personnel in the mine atmosphere.

Set up on the surface is a separator 21 (cf., FIG. 2) serving for the separation of oil from water and mechanical impurities.

Supplied to the oil bed 9 for heating the latter is a heating medium T such as hot water. The coolant T is supplied from a heat source such as steam boiler (not shown in the drawings) located on the surface via the well 13 (FIG. 4) into the manifold 14. From the manifold 14 the hating medium T is supplied over the branch pipes 15 to each one of the development wells 10 via pipes 16. Upon entering the pipe 16, near the mouth of the development well, the flow of coolant is throttled by passing it through the throttling means 17. On leaving the orifice of the throttling means (union pipe), the flow of heating medium diverges while its pressure drops down to bring about a reduction in the heating medium losses beyond the limits of the section 1 being heated (FIG. 1), as well as about a uniform distribution of heat in the body of the oil bed 9 (FIG. 2) of the section 1 being heated (FIG. 1).

The throttled flow of heating medium T is delivered via pipes 16 (FIG. 4) to the faces of the development wells 10, after which it is supplied to the annular space and passed therealong towards the mounts of the wells 10 while yielding its heat to the oil bed 9 (FIG. 2) through the walls of the wells 10 and natural zones of disturbance of the oil bed 9.

As a result of throttling its flow, the coolant delivered to the pipe 16 (FIG. 4) in the form of steam assumes a low excess pressure required to ensure its movement in the well 10. While yielding its heat to the oil bed 9, the steam is condensed and flows from the well 10 into the development gallery 8 in the form of condensate (hot water). In so doing, the throttling of the heating medium flow makes for a reduction of its heat losses into the atmosphere of the development gallery 8. The parameters (amount, pressure and temperature) of heating medium supplied into the development wells 10 are controlled by varying the pressure in the manifold 14.

Figure 4:
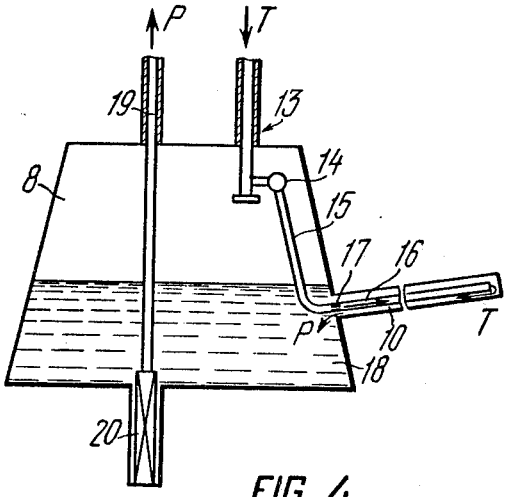
FIG. 4 shows diagrammatically the arrangement of equipment in an oil bed underground working.

After the oil bed 9 (FIG. 2) has been heated by the heating medium to a temperature at which oil assumes the required fluidity, a fluid medium M is force-fed to the intake wells 11 from the surface or underground workings to drive heated oil from the section 1 (FIG. 1) of the oil bed 9 (FIG. 2) into the development wells 10. The oil forced out into the development wells flows down the annular space of the latter together with the heating medium, which has yielded part of its heat to the oil bed, and into the development gallery 8 in the form of pulp 18 (FIG. 4). The movement of the pulp 18 is shown in the drawing with arrow P.

During the movement of heating medium and heated oil in the annular space of the development well 10, the walls of the latter may deteriorate to form sand plugs between the pipes 16 and the well walls. In this case, the operation of the throttling means 17 results in an increase of the pressure in the well 10 up to the pressure in the manifold 14 to force the sand out of the well 10 and into the development gallery 8. This helps obviate the need for repairing development wells to eliminate sand plugs and, as a result, the process of oil recovery can be performed without the presence of personnel in the development gallery 8.

Throttling provides for the control over the feed of heating medium into the development wells and for automatic elimination of sand plugs in said wells without resorting to the use of special means of automation and without the presence of personnel in the oil bed workings.

Thanks to throttling, basic technological operations of delivering the heating medium into the oil bed and extracting oil therefrom can be performed in oil bed workings separated from the overall mine ventilation system.

The pulp 18 accumulated in the development gallery is pumped up to the surface by means of the pump 20 via hole 19. The pumping of the pulp 18 by the pump 20 to the surface directly from the development gallery 8 via hole 19 ensures a reduction of heat losses to the mine atmosphere, whereas prior art methods are characterized by pumping from the mine a hot pulp via long pipelines laid out in underground workings.

The pulp 18 is pumped through the separator 21 (FIG. 2) in which oil is separated from water and mechanical impurities.

Figure 3:
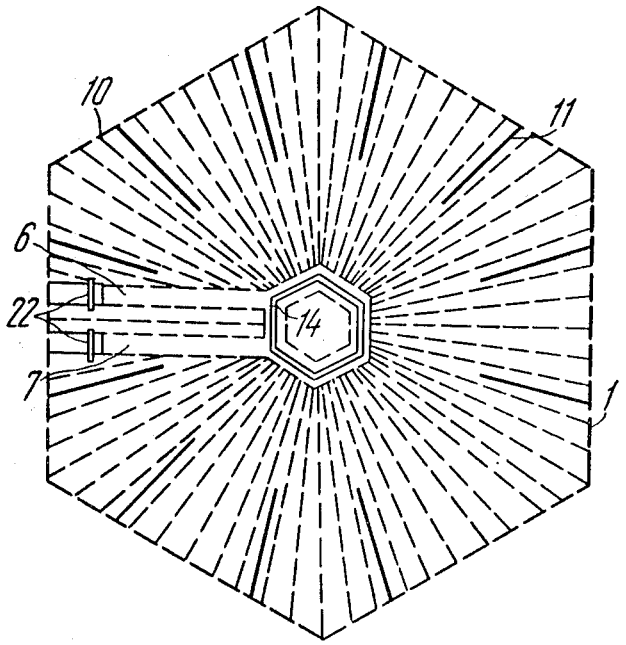
FIG. 3 is a section taken on the line III—III of FIG. 2.

Prior to the delivery of the throttled flow of coolant T into the development wells 10, the underground workings of the section 1 being heated (FIG. 1) of the oil bed 9, such as the incline 6, footway 7 and development gallery 8, are separated from the overall mine ventilation system with the aid of isolating means 22 (FIGS. 2, 3).

The isolating means 22 may include single seals or groups of seals made of various heat-insulting and airproof materials which permit to seal off underground workings located in the oil bed from the main preparatory haulage workings 4 (FIG. 1) and ventilation workings 5, ventilated by the all-mine ventilation jet.

The isolation of underground workings of a section, for example, section A, being heated of the oil bed 9 (FIG. 2) (incline 6, footway 7 and development gallery 8) from the overall mine ventilation system provides for normalization of temperature conditions in the main preparatory ventilation workings 5 and for a considerable increase of oil recovery without additional ventilation costs whereas, in the case of ventilated oil bed workings, the development of additional sections with a view to increasing the productive capacity of an oil mine would call for an additional supply of air to the mine for the purpose of ventilating said workings and, consequently, for the construction of additional mine shafts with ventilation units and drifting of other additional underground workings capable of passing through the required amount of air for ensuring the safety of mine operation. In addition, the isolation of oil bed underground workings from the overall mine ventilation system makes for a higher heat efficiency of the thermal drive process whereas, in the case of ventilation of said workings, a thermal head is created as a result of large temperature differences between the heated body of the oil bed and ventilation jet-cooled walls of the oil bed workings, said thermal head making for an intensified supply of heat to the atmosphere of said workings thereby increasing the losses of heat supplied to the oil bed by the heating medium.

The commencement of the development of sections of the oil bed 9 (FIG. 2), i.e., the delivery of coolant T to the development wells 10 and the isolation of the oil bed underground workings such as the incline 6, footway 7 and development gallery 8 from the overall mine ventilation system, is effected successively in the sections 1 (A, B, C), as shown in FIG. 1, starting from the boundaries 23 of the mine field H towards the central portion thereof where the mine shafts 2 and 3 are located.

In so doing, after the setting up of the sections 1 (A, B, C) is completed, part of the main preparatory haulage 4 and ventilation 5 workings servicing the aforementioned sections are separated from the overall mine ventilation system with the aid of isolating means 24 similar in design with the isolating means 22 (FIG. 2).

The development of the sections 1 (FIG. 1) of the mine field H in the direction from the boundaries thereof towards the mine shafts 2 and 3 provides for the normalization of temperature conditions in the main preparatory haulage underground workings 4 and ventilation workings 5 since their ventilated portion is located only in the bodies of rocks with natural temperature. When heating the oil bed, this helps preclude the cooling of the latter by the ventilation of the main preparatory underground workings over their entire length and increase the efficiency of heating the entire oil bed with heating medium while reducing the consumption of the latter for the recovery of oil.

The heating medium T is delivered to the development wells 10 (FIG. 4) via pipes 16 which are thermoisolated at the wellhead and run down to the face of said wells. This makes for an increased area of contact of the moving flow of heating medium T in the development well 10 with the oil bed 9 (FIG. 2) over the entire length of said well, as well as provides for the entrainment by the heating medium of sand from the well 10 over the entire length of the latter and helps reduce the shut-down time of the wells due to plugging. Thermoisolating of the pipe 16 at the wellhead of well 10 eliminates the heating of the pulp in that zone.

The development wells are not cased if the rock of the oil bed 9 is well cemented and stable to heating. In case the rock of the oil bed is poorly cemented, the wells may be equipped with filters of known construction. This helps establish a direct contact of the heating medium T with the oil bed 9 and utilize most fully the entire uncased surface of the development well 10 for the filtration of oil from the oil bed, thereby increasing the well output and reducing the cost of outfitting the development wells 10.

Following the delivery of heating medium T to the development wells 10 for heating the oil bed 9 of the starting section A (FIG. 1) of the mine field H, the same heating medium is re-cycled to the development wells of the section B in accordance with the flow sequence of developing the mine field.

Following the work on preparing the first, say, three, sections A, B and C near the boundary 23 of the mine field H serviced by one pair of main preparatory workings (haulage working 4 and ventilation working 5), steam is supplied to the system of wells 10 of the section A in the manner described above while hot water pumped up to the surface from the gallery 8 of the section A and separated from oil in the separator 21 (FIG. 2) is directed via well 13 (FIG. 4) and manifold 14 into the system of wells 10 of the section B (FIG. 1) where the thermal drive and oil recovery technique is analogous to that used in the section A but under less intence temperature conditions. Then, water containing residual heat, pumped up to the surface from the gallery 8 of the section B and separated from oil, is pumped into the system of wells 10 of the section C for preheating the latter, while water pumped up from the gallery 8 of the section C and separated from oil is used as the fluid medium M (FIG. 2) pumped into the bed 9 via wells 11 for driving oil from the oil bed 9 of the section A into the development wells 10.

After the heat transfer process in the section B dies out due to the lowering of the temperature difference between the heating medium and oil bed 9 (FIG. 2), the latter is converted to the steam pumping mode while the section C (FIG. 1) is simultaneously converted to the initial mode of the section B. The process is further repeated in accordance with the aforedescribed sequence. If the development of the mine field is carried out with the aid of two or more pairs of main preparatory haulage workings 4 and ventilation workings 5, the sections are developed synchronously over the entire front of the oil bed 9. The pre-heating of the sections helps increase the thermal efficiency of the process owing to the maximum utilization of heat supplied to the bed.

The complexity of the herein disclosed techniques of the present invention provides a method of thermal mining development of high-viscosity oil deposits, ensuring the maximum production capacity of the oil mine with high economic efficiency and labor safety.

What is claimed is:

1. A method of oil recovery by thermal mining from oil deposit sections into which a mine field is divided, wherein a plurality of underground workings are provided ensuring a successive recovery of oil from the mine field sections and including intake and development wells, and an overall mine ventilation system is set up ensuring the ventilation of the underground workings, after which a flow of heating medium is throttled and force-fed via pipes into the development wells for heating the oil bed to a temperature at which oil assumes the required fluidity in the oil bed, whereupon a fluid medium is force-fed to the intake wells to drive oil from the oil bed into the development wells and pump it out up to the surface, the throttling of the heating medium before the force-feeding of the same automatically controlling the force-feeding of the heating medium to, extracting oil from and cleaning of the development wells.

2. A method as set forth in claim 1, wherein, prior to the supply of the throttled flow of heating medium to the development wells, the underground workings of the oil bed section being heated are separated from the overall mine ventilation system.

3. A method as set forth in claim 2, wherein the supply of heating medium and separation of the oil bed underground workings from the overall mine ventilation system are carried out successively in the mine field sections, starting from the mine field boundaries towards the central portion thereof.

4. A method as set forth in claim 2, wherein the supply of heating medium and separation of the oil bed underground workings from the overall mine ventilation system are carried out successively in the mine field sections, starting from the mine field boundaries towards the central portion thereof.

5. A method as set forth in claim 1, wherein the flow of heating medium to the development wells is delivered via pipes thermoisolated at the wellhead and run down to the face of said wells.

6. A method as set forth in claim 1, wherein the flow of heating medium is delivered into uncased development wells or into wells equipped over the entire length with filters.

7. A method as set forth in claim 1, wherein, following the supply of heating medium to the development wells for heating the oil bed of the first section of the mine field, the same heating medium is re-cycled to the development wells of the adjacent section in accordance with the flow sequence of developing the mine field sections.

* * * * *